United States Patent [19]

Hwang

[11] Patent Number: 4,982,812

[45] Date of Patent: Jan. 8, 1991

[54] NOISE-PREVENTIVE MEANS FOR COMPRESSOR USED IN AIR CONDITIONER

[76] Inventor: Min-su Hwang, P.O. Box 10160, Taipei, Taiwan

[21] Appl. No.: 426,007

[22] Filed: Oct. 24, 1989

[51] Int. Cl.[5] ..... G10K 11/00

[52] U.S. Cl. ..... 181/202; 415/119

[58] Field of Search ..... 181/198, 200, 202, 204, 181/403; 415/108, 119

[56] References Cited

U.S. PATENT DOCUMENTS

| | | | |
|---|---|---|---|
| 3,132,715 | 5/1964 | Dunsbee | 181/202 |
| 3,160,227 | 12/1964 | Hautale | 181/200 |
| 3,260,974 | 7/1966 | Specht et al. | 181/202 X |
| 4,347,093 | 8/1982 | Morris | 181/202 X |

*Primary Examiner*—Benjamin R. Fuller

[57] ABSTRACT

A noise-preventive apparatus for compressor used in an air conditioner includes a double-wall vacuum jacket encompassing a compressor in the vacuum jacket so that the noise caused in a runnign compressor will not be transmitted outwardly through a vacuum chamber formed in the double-wall vacuum jacket for preventing noise pollution in an air conditioner.

1 Claim, 3 Drawing Sheets

NOISE-PREVENTIVE MEANS FOR COMPRESSOR USED IN AIR CONDITIONER

BACKGROUND OF THE INVENTION

In a conventional air conditioner such as a window type air conditioner may occur noise from the running of the compressor in the conditioner. Even a sound-absorbing material such as a glass wool may be lined on the compressor housing for shielding the noise, the noisy sound may still penetrate and transmit through the perforations or void portions in the sound-absorbing material to cause an uncomfortable feeling for someone living in a room, especially at night (sleeping) time. Meanwhile, the conventional sound-absorbing material only encompasses the cylindrical wall of the compressor housing so that the noise sound may transmit outwardly through the upper and bottom portions of the compressor housing, still spreading noise sound outwardly.

The present inventor has found the drawback of a conventional compressor in an air conditioner and invented the present noise-preventive means for compressor used in an air conditioner.

SUMMARY OF THE INVENTION

The object of the present invention is to provide a noise-preventive means for a compressor by mounting the compressor in a double-wall vacuum jacket so that the noise caused by a running compressor will be shielded by the vacuum jacket for preventing noise pollution from a compressor of an air conditioner or air conditioning system.

DETAILED DESCRIPTION

Sound is caused by the vibrations of air molecules which produce a series of pulses of compressions and rarefactions to be listened by a human ear as sensed by his or her brain. Such compressions and rarefactions of air molecular vibrations will produce air pressure in terms of sound pressure. A particle when colliding another particle will run a distance called mean free path. The mean free path of an air molecule inside a vacuum instrument will become larger. In a free molecular flow region, one air molecule runs from a side wall of a vacuum instrument to the other opposite side wall will not be in collision with any other molecule so that the molecular flow in such a flow region is independent of the air pressure to minimize the collision opportunities between air molecules, thereby not producing air pressure and sound.

The present invention discloses a noise-preventive means for a compressor used in an air conditioner or an air conditioning system by using the principles as aforementioned.

Figure 1:
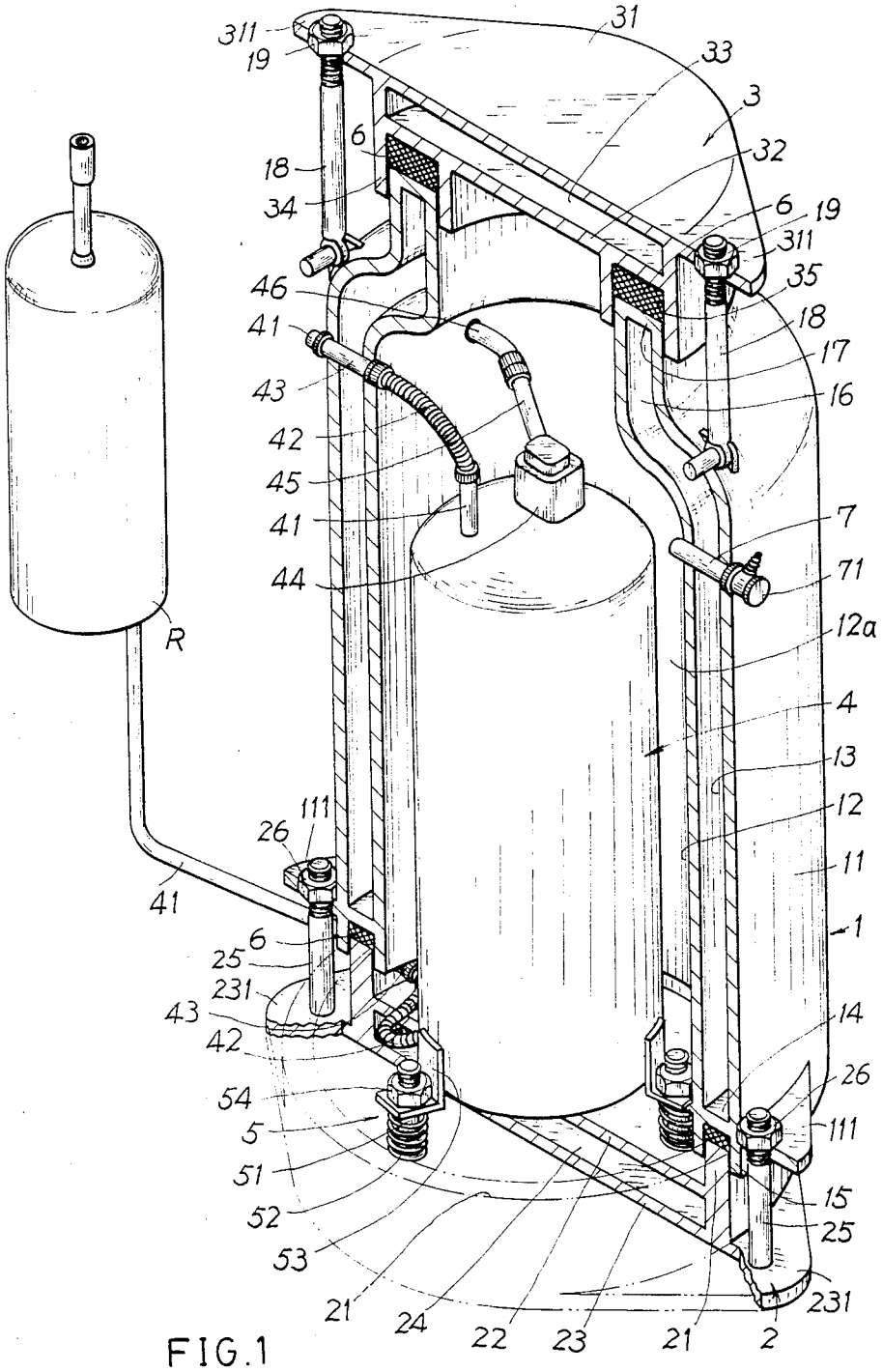
FIG. 1 is an illustration showing all elements in construction of the present invention.
Figure 2:
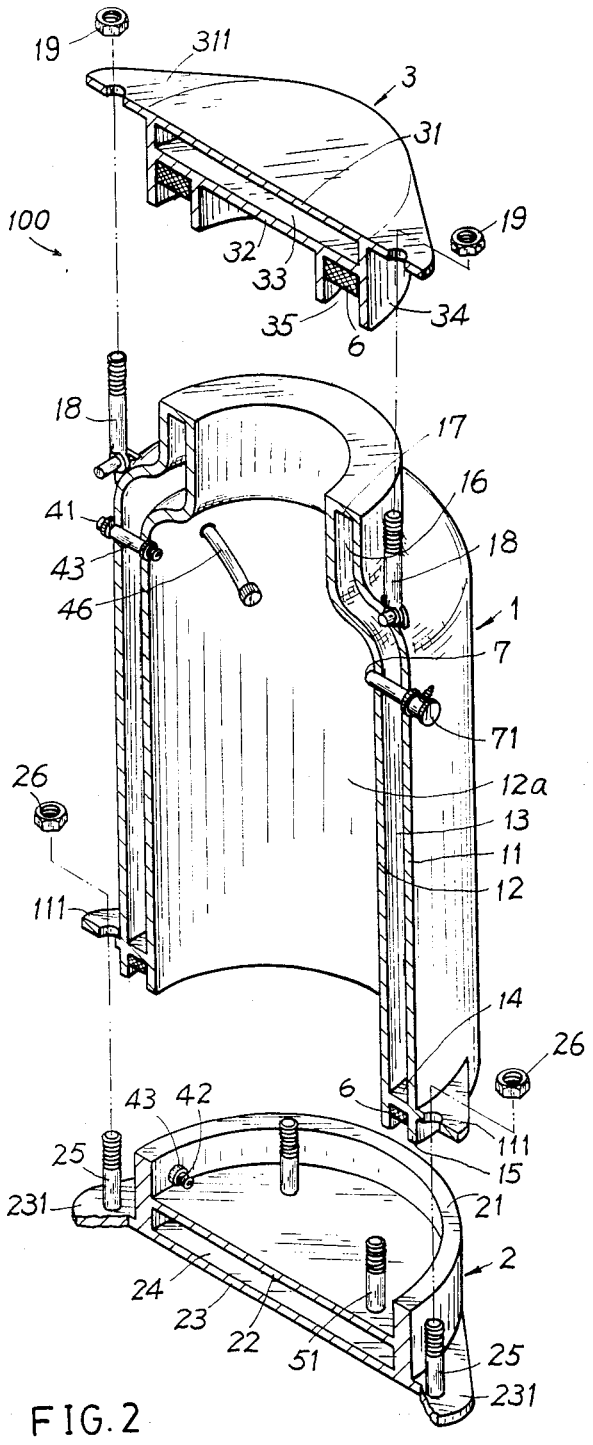
FIG. 2 is an illustration of an exploded view of the vacuum jacket of the present invention.
Figure 3:
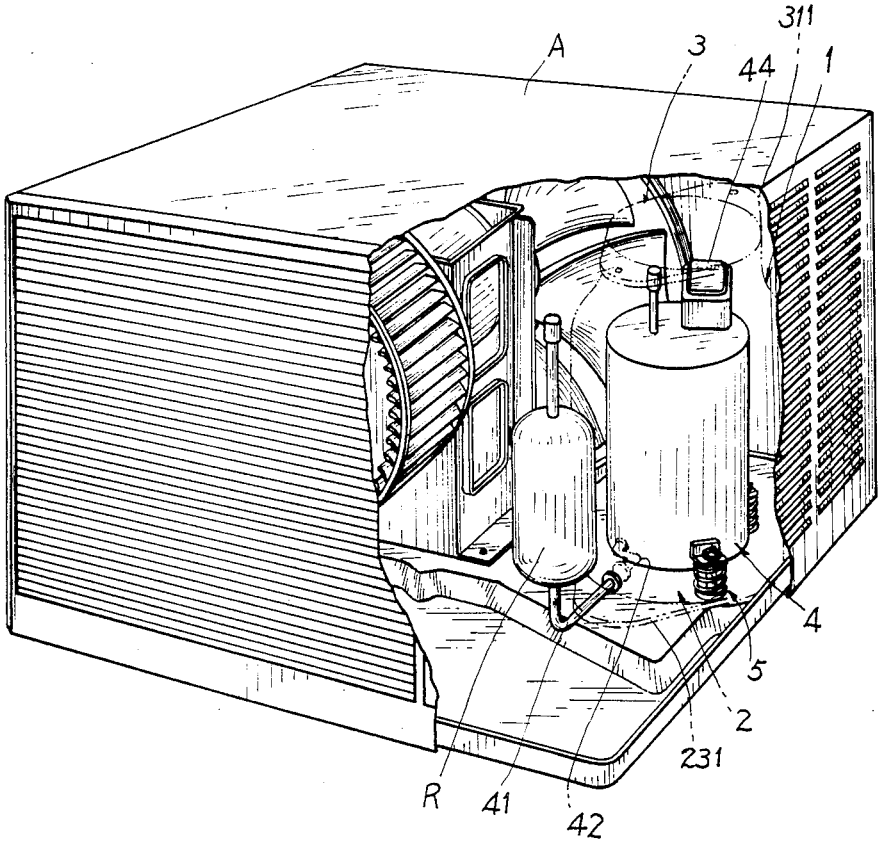
FIG. 3 is an illustration showing an application of the present invention used in an air conditioner.

The noise-preventive means of the present invention comprises a double-wall vacuum jacket 100 for encompassing a compressor 4 used in an air conditioner in the vacuum jacket 100. As shown in FIGS. 1 and 2, the double-wall vacuum jacket 100 comprises: a main jacket 1, a bottom jacket 2, an upper jacket 3, a plurality of shock absorbers 5, and a plurality of packing members 6.

The main jacket 1 includes: an outer cylindrical wall plate 11, an inner cylindrical wall plate 12 defining a cylindrical vacuum chamber 13 with the outer wall plate 11, an annular bottom plate 14 formed on a bottom portion of the main jacket 1 closing the bottom portion of the jacket 1, a lowest annular groove 15 formed on a bottom surface of the annular bottom plate 14, an upper cylindrical extension 16 formed on an upper portion of the jacket 1, and an annular top plate 17 closing the top portion of the jacket 1.

The bottom jacket 2 includes: a lower cylindrical extension wall plate 21 protruding upwardly from the jacket 2 engageable with the lowest annular groove 15 of the main jacket 1, a compressor-mounting base plate 22 for securing the compressor 4 thereon confined within the cylindrical extension wall plate 21, and a lowest bottom plate 23 confined within the extension wall plate 21 under the base plate 22 defining a lower circular vacuum chamber 24 between the base plate 22 and the bottom plate 23.

The upper jacket 3 includes: an uppermost plate 31 having top flange 311 protruding laterally to be secured to the main jacket 1 by means of a plurality of bolts 18 fixed on the jacket 1 and nuts 19, a cover plate 32 formed and confined within an upper cylindrical extension wall plate 34 protruding downwardly from the plate 31, an upper circular vacuum chamber 33 defined between the two plates 31, 32, and an upper annular groove 35 formed on a bottom periphery of the cover plate 32 engageable with the upper cylindrical extension 16 of the main jacket 1.

The bottom jacket 2 is secured to the main jacket 1 by a plurality of bolts 25 secured on a bottom flange 231 each bolt 25 protruding upwardly through a lower flange 111 formed on a lower portion of the outer wall plate 11 and fixed by a nut 26 as shown in FIGS. 1, 2.

Either annular groove 35 or 15 is inserted a packing member 6 therein for sealing the engagement between the upper jacket 3 with the main jacket 1 or between the bottom jacket 2 with the main jacket 1. The packing member 6 may be a packing ring, a gasket, an O-ring made of elastomer or rubber, plastic or any other packing materials. A sealant such as silicon grease or resin may also be added into the groove 35 or 15 for sealing any aperture among the jackets.

Each jacket 1 or 2 or 3 should be pre-evacuated to form vacuum such as in mass production in a factory so as to form a vacuum chamber 33 in upper jacket 3, a vacuum chamber 13 in main jacket 1, and a vacuum chamber 24 in bottom jacket 2.

Each shock absorber 5 includes a bolt 51 fixed on the base plate 22, a tension spring 52 jacketed on the bolt 51, a bracket 53 fixed on the housing of the compressor 4 resiliently retained on the spring 52, and a nut 54 fixing the bracket 53 on the bolt 51.

Several refrigerant conduits 41 are provided in the air conditioner A communicated between a container R, the compressor 4 and the other system elements (not shown), which conduit 41 when passing the jackets 1, 2 should be connected with a flexible tube 42 (made of stainless steel) through a guiding pipe 43 passing through the jackets 1, 2. The guiding pipe 43, and the conduit 42 when passing through the jackets 1, 2 should be welded to the jackets to prevent any air leakage through any apertures existing therebetween. An electric connector 44 of electric wires 45 is electrically connected to a power source through a connecting pipe 46 passing through the jacket 1, in which a welding should also be provided for sealing any aperture between the pipe 46 and the jacket 1.

The central chamber 12a defined within the inner wall plate 12 is evacuated to form vacuum by means of venting pipe 7 poking into the chamber 12a through the double wall plates 12, 11, which pipe 7 is connected to a vacuum pump (not shown) for forming the vacuum and controlled by a valve 71 as shown in the figures. The pipe 7 should also be welded to the jacket 1.

Since the air compressor 4 is encompassed int he double-wall vacuum jacket 100 in accordance with the present invention, the noise caused in a running compressor will not be transmitted outwardly through the jackets because the central chamber 12a; and the vacuum chambers 13, 24, 33 respectively formed in the main jacket 1, the bottom jacket 2 and the upper jacket 3 are all evacuated to form vacuum, without transmitting the noise.

Accordingly, this invention may provide a silent compressor used in an air conditioner for preventing noise pollution. Meanwhile, the shock absorber 5 also helps reduce the vibrations of compressor running to reduce the noise caused from the compressor.

I claim:

1. A noise-preventive apparatus for a compressor used in an air conditioner comprising: a double-wall vacuum jacket comprised of a bottom jacket secured with said compressor thereon, a main jacket sealably mounted on said bottom jacket and disposed around said compressor, and an upper, jacket sealably mounted on said main jacket as a covering for said double-wall vacuum jacket; said main jacket including an inner cylindrical wall plate defining a central chamber in combination with said upper and bottom jackets in which said central chamber is evacuated for forming a vacuum by means of a venting pipe extending through said main jacket, an outer cylindrical wall plate formed outside the inner wall plate an defining a cylindrical vacuum chamber between said inner and outer wall plates, an annular bottom plate formed on a lower portion of said main jacket for closing a lower portion of said cylindrical vacuum chamber, a lowest annular groove formed on a bottom surface of said annular bottom plate, and an upper cylindrical extension formed on an upper portion of said main jacket having an annular top plate closing an upper portion of said cylindrical vacuum chamber; said bottom jacket including: a lower cylindrical extension wall plate engageable with said lowest annular groove of said main jacket as and being packed by a packing ring inserted in said annular groove and sealed by a sealant filled in said groove, a compressor-mounting base plate confined within said lower cylindrical extension wall plate for mounting said compressor thereon, a lowest bottom plate confined within said lower cylindrical extension wall plate under said base plate and defining a lower circular vacuum chamber between said base plate and said lowest bottom plate, and a bottom flange having bolts secured to a lower flange formed on said outer wall plate of said main jacket for connecting, said main jacket to said bottom jacket; and said upper jacket including: an uppermost plate having a top flange secured to said main jacket by bolts fixed on said main jacket, a cover plate confined within an upper cylindrical extension wall plate protruding downwardly from said uppermost plate, an upper vacuum chamber defined between said uppermost plate, said cover plate and said upper extension wall plate, and an upper annular groove formed on a perimeter of a bottom surface of said cover plate engageable with said upper cylindrical extension formed on said main jacket and being packed by a packing ring inserted in said upper annular groove and sealed by a sealant filled in said groove, whereby due to the vacuum formed in said central chamber defined by said inner cylindrical wall plate of said main jacket in combination with said upper and bottom jackets, and the vacuum formed between respective plates of said main jacket, said bottom jacket and said upper jacket, so sound or noise will be transmitted from operation of said compressor, and thereby said apparatus forming a noise-preventive means for suppressing noise from said compressor for noise prevention function.

* * * * *